United States Patent [19]

Wendt et al.

[11] 4,258,821

[45] Mar. 31, 1981

[54] SOUND-ABSORBENT BLOWER COVER

[76] Inventors: Gary R. Wendt, 2 W. Main St., Ventura, Calif. 93001; Maurice P. Walsh, 1512 Lincoln La., Newport Beach, Calif. 92663

[21] Appl. No.: 10,137

[22] Filed: Feb. 7, 1979

[51] Int. Cl.[3] ..... F01N 1/24; H02K 5/24

[52] U.S. Cl. ..... 181/202; 181/205; 181/258

[58] Field of Search ..... 181/200, 204, 207, 211, 181/229, 217, 218, 224, 230, 243, 233, 252, 256, 258, 282, 202; 417/312, 313; 55/276, DIG. 21

[56] References Cited

U.S. PATENT DOCUMENTS

| | | | |
|---|---|---|---|
| 2,050,581 | 8/1936 | Orem | 181/229 |
| 2,764,142 | 9/1956 | McMullen | 181/229 |
| 3,534,828 | 10/1970 | Iver et al. | 181/204 |
| 3,589,971 | 6/1971 | Reed | 181/200 |
| 3,789,954 | 2/1974 | Raleigh | 181/205 |

FOREIGN PATENT DOCUMENTS

| | | | |
|---|---|---|---|
| 1390359 | 1/1965 | France | 181/200 |

OTHER PUBLICATIONS

South Coast Innovations, "Spa Noise . . . Get Rid Of It" . . . , Eliminator Device.

*Primary Examiner*—L. T. Hix
*Assistant Examiner*—Benjamin R. Fuller

[57] ABSTRACT

A flexible sound-absorbent blower cover includes an outer skin of a pliable material shaped to surround the blower and conforming generally to the shape of the blower but oversize to provide a space between the outer skin and the blower. A flexible porous sound-absorbent liner is disposed in the space and is bonded to the outer skin. The blower draws air in through the liner which filters the air. The structure of the flexible one piece cover prevents it from resonating. The cover is provided with a slit which can be opened to facilitate installation and then closed to keep the cover in place on the blower.

12 Claims, 3 Drawing Figures

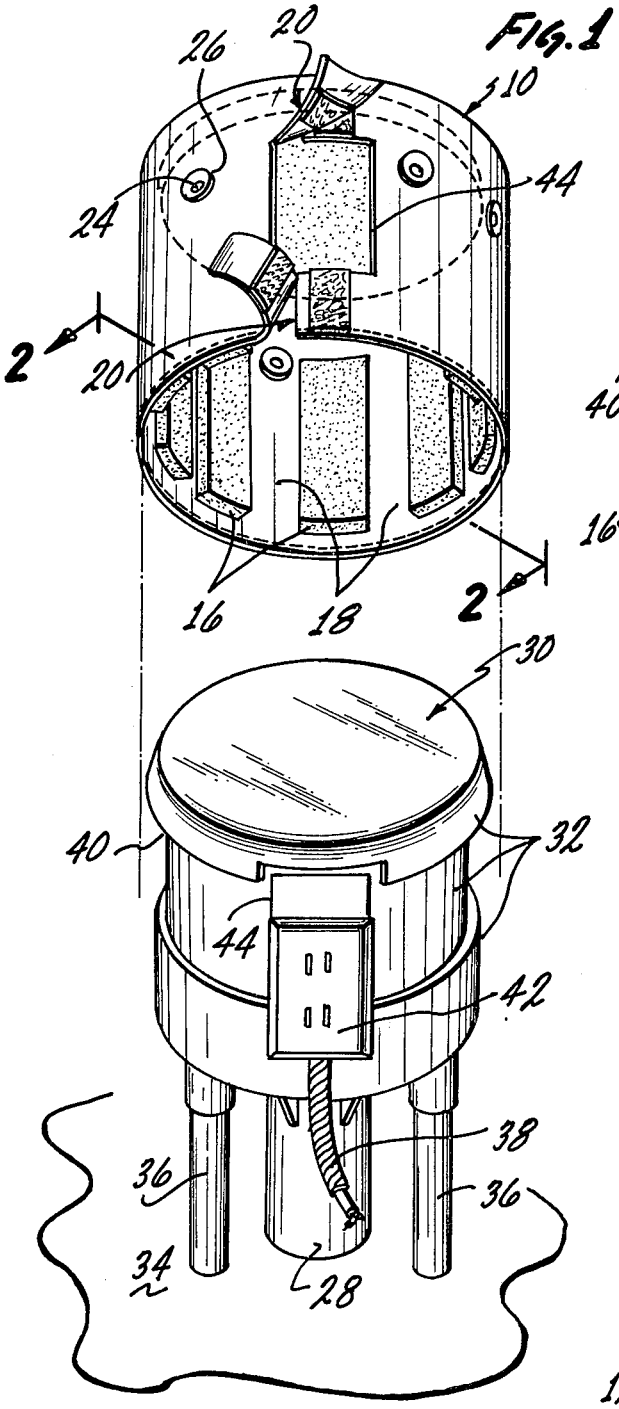
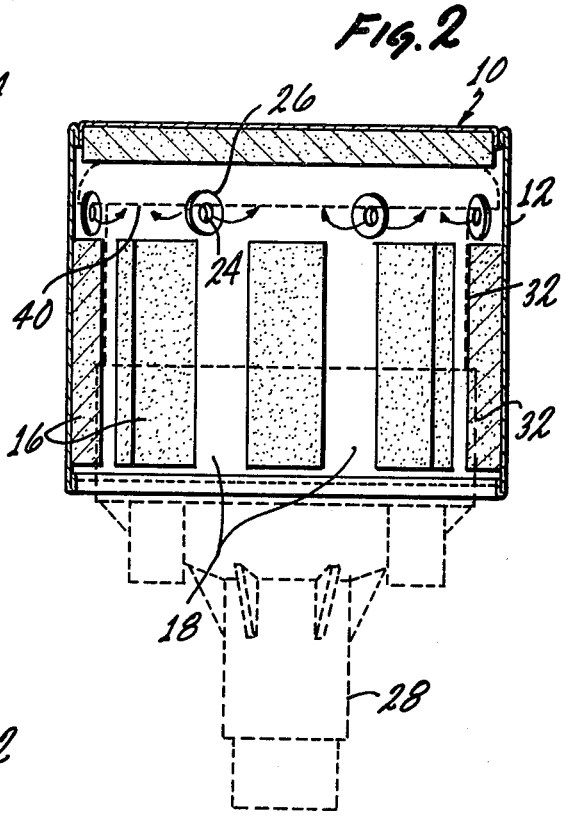
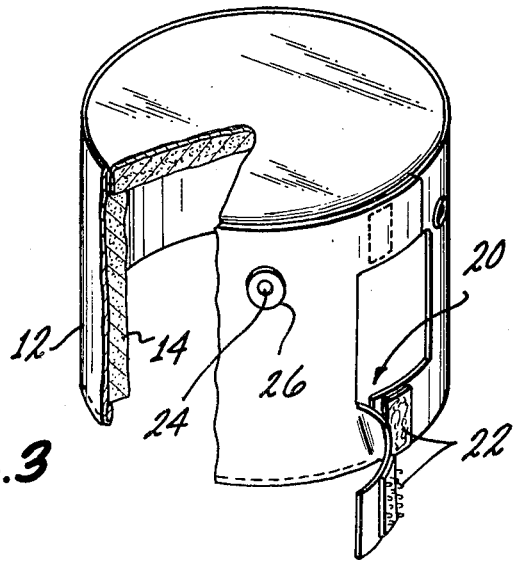
FIG. 3

SOUND-ABSORBENT BLOWER COVER

BACKGROUND OF THE INVENTION

1. Field of the Invention

The present invention is in the field of swimming pool equipment and more particularly relates to a sound-absorbent cover for a blower of the type used to supply air to a spa.

2. The Prior Art

Most spas are provided with an air blower for introducing a stream of air into the water as it is injected into the spa. Blowers currently on the market are built in the form of an upright cylinder approximately 9 inches in diameter and approximately 9 inches high. The blower normally is provided with an air intake opening, and further includes an electric motor which drives an air impellor which forces the air out of the blower through an outlet duct which conducts the air into the spa. Such blowers are designed for high performance and the working parts are enclosed within a housing which is designed to prevent tampering and to keep out water. Typically, the housing includes an electrical connection for powering the blower, and typically, the outlet duct extends downward beneath the blower which may be mounted a foot or so off the ground on legs.

Enough people find the blowers described above to be noisy that a market exists for an add-on muffling cover. The primary requirement of such a cover is that it be capable of muffling the sound. In addition, it must not adversely affect the flow of air into the blower, it should be inexpensive to manufacture, and it should be easy to install on existing blowers.

To the extent that the sound-absorbent material does not cover the air intake aperture of the blower, the noise reducing cover will be inefficient. On the other hand, if the air intake aperture is covered by the sound-absorbent material, the air cannot freely be drawn into the blower and as a result, the motor will overheat and burn out. As will be seen below, the present invention provides a simple and effective solution to this dilemma.

In one noise reducer known to be on the market, the blower is enclosed in a rigid inverted can and the can is closed at the bottom by screwing to it a rigid bottom which is supplied in two halves, the latter being brought into position from the side to surround the downwardly extending outlet duct, and being attached to the inverted can by a flange around the edges of the halves. A number of problems are implicit in such a design. Because the can is rigid it is capable of resonating at some of the frequencies present in the noise generated by the blower and, therefore, its muffling efficiency might be reduced. Further, the rigid halves forming the bottom of the can may vibrate against the can or against portions of the blower to generate noise. It is also possible that the screws holding the bottom of the can might vibrate loose. As will be seen below, the present invention eliminates these potential problem areas by use of an entirely different design approach.

SUMMARY OF THE INVENTION

Resonance and vibration of the parts of the cover are eliminated by the structure of the present invention, in which the entire cover consists of pliable materials. Specifically, in the present invention, the cover includes an outer skin of a pliable material having a shape similar to the shape of the blower, but oversize so that sound-absorbent material can be disposed between the outer skin and the blower.

In the present invention, the sound-absorbent material is a flexible porous substance such as a plastic foam, and the sound-absorbent material is disposed in such a manner that some of the air taken in by the blower passes through the sound absorbent material before reaching the air intake so that the air is filtered to some extent by the sound-absorbent material. In this manner, sound emanating from the air intake of the blower is muffled without unduly interfering with the free flow of air into the air intake aperture.

In a preferred embodiment, the sound-absorbent liner material is bonded to the outer skin of the cover.

In a preferred embodiment of the present invention, the cover has a cylindrical shape and includes a slit up one side to permit it to be installed easily. After installation, the slit is closed by a fastener. One cover now on the market includes three separate pieces which must be screwed together, thereby requiring five minutes for installation and the use of a special tool. In contrast, the cover of the present invention can be installed in a matter of seconds without the need for any tools. Because the cover of the present invention is a single composite structure, there are no parts which can vibrate loose and fall off.

The novel features which characterize the invention, both as to its structure and method of installation and operation, together with further object and advantages will be better understood from the following description considered in connection with the accompanying drawings in which a preferred embodiment of the invention is illustrated by way of example. It is to be expressly understood, however, that the drawings are for the purpose of illustration and description and are not intended as a definition of the limits of the invention.

BRIEF DESCRIPTION OF THE DRAWINGS

FIG. 1 is an exploded perspective view showing both the cover and the blower;

FIG. 2 is a cross-sectional view of the cover taken in the direction 2—2 of FIG. 1 and showing the cover installed on a blower, the blower being shown in dashed lines; and, FIG. 3 is a perspective view of the cover with a section cut away to show its construction.

DETAILED DESCRIPTION OF THE PREFERRED EMBODIMENT

Turning now to the drawings in which like parts are denoted by the same reference numeral, there is shown in FIG. 1 an exploded perspective view of the cover 10 of the present invention which is designed to fit over and surround the blower 30. The cover 10 includes an outer skin 12 of a pliable material. The outer skin 12 has a shape which permits it to be slipped over the blower 30. In a preferred embodiment, the outer skin, while conforming in shape generally to the shape of the blower 30, is sized to fit the blower rather loosely so that a space remains between the outer skin and the body 32 of the blower when the cover is installed on the blower. In accordance with the present invention, the space between the cover 10 and the blower 30 is partially filled by a sound-absorbent flexible liner material 14. In one embodiment, the liner material 14 includes separate pieces 16 of liner material disposed within the space to form air passages 18 between the separate pieces 16 through which air will be drawn to the air intake aperture 40 of the blower. In another embodiment, the porous material 14 consists of a unitary piece of liner material through which the air is drawn. In a preferred embodiment, the liner material is a flexible porous sound absorbing material such as plastic foam of the open cell type.

In a preferred embodiment, the outer skin 12 is a waterproof, pliable material such as vinyl or treated cloth.

In a preferred embodiment, the liner material 14 is bonded to the inner surface of the outer skin 12 so as to be affixed to it.

In a preferred embodiment, the cover 10 includes a fly 20 which is a closable slit concealed beneath a flap. The fly 20 is held closed when the cover has been installed by means of the fastener 22.

The cover 10 of the present invention is especially easy to install; installing it is similar to putting on a pair of pants. With the fly 20 open, the cover 10 is pulled over the blower 30, and then the fastener 22 is closed, completing the installation in a matter of a few seconds. In one embodiment, an aperture 44 is provided to permit the junction box 42 to extend through the cover.

In one embodiment of the present invention, several auxiliary air passages 24 are provided to facilitate the entry of air. The auxiliary air passages 24 are protected by grommets 26.

Typically, the blower 30 includes a rigid body 32 which may be made of plastic, the legs 36 which support the blower 30 above the ground 34, an outlet duct 28 for the air, an air intake aperture through which the air is drawn into the blower, and an electrical junction box 42 in which the electrical wires in the conduit 38 are connected to the blower motor leads.

Clearly, the cover 10 of the present invention is not limited to use with blowers of the configuration shown. The structural features which characterize the present invention are applicable to covers shaped for use with blowers of other shapes. For example, the design of a cover for use on a cube-shaped blower would be straightforward in view of the disclosure given above. Further, it is clear that the cover of the present invention in not limited for use with spa blowers, but instead, can be used with blowers of other kinds, including without limitation, air conditioning and furnace blowers, as well as industrial blowers of various kinds.

Summarizing, it is seen from the above description that the particular advantages of the blower cover of the present invention result from its unique structure. Because the cover of the present invention consists entirely of flexible material, it is impossible for the cover to resonate in response to the noise generated by the blower. The cover consists of a single unitary piece, making it impossible for parts of it to vibrate against one another. Also, because the cover consists of a single piece, it is not necessary to assemble the cover in place on the blower. Installation of the cover of the present invention is as simple as putting on a pair of pants. The sleeve-like cover is simply pulled over the blower and a fly is then closed completing the installation. As a result, the cover can be installed in a matter of seconds.

In a preferred embodiment, all of the air drawn into the blower passes through a porous liner material, which filters the incoming air. In a preferred embodiment the incoming air passes over an appreciable portion of the body of the blower, and this is helpful in warming the air when the blower is used in cold ambient temperatures, such as might be encountered in ski resorts or in winter. This use of energy which otherwise would be wasted helps to reduce the heating requirements of the spa, since the latter will be cooled less by the heated air.

The foregoing detailed description is illustrative of several embodiments of the invention but it is to be understood that additional embodiments may be obvious to those skilled in the art. The embodiments described herein together with those additional embodiments are considered to be within the scope of the invention.

What is claimed is:

1. A flexible sound-absorbent cover for installation on a blower of the type having a rigid body including an air intake aperture, a motor and an air impellor, the blower being connected to an outlet duct, said flexible cover comprising:

an outer skin of a pliable material of such a shape as to surround the blower, and to conform generally to the shape of the blower but oversize so that a space exists between the blower and said outer skin; and, liner material of a sound-absorbent flexible porous substance affixed to said outer skin and so disposed in the space between the blower and said outer skin that some of the air taken in by the blower passes through said liner material before reaching the air intake, whereby said liner material filters some of the air taken in, said liner material occupying an appreciable portion of the space between the blower and said outer skin.

2. The flexible sound-absorbent cover of claim 1 wherein said substance is an open cell plastic foam.

3. The flexible sound-absorbent cover of claim 1 wherein said liner material is bonded to said outer skin.

4. The flexible sound-absorbent cover of claim 1 wherein said liner material further comprises several separate pieces of said sound-absorbent flexible porous substance.

5. The flexible sound-absorbent cover of claim 4 wherein said separate pieces are spaced apart to define an air passage leading to the air intake.

6. The flexible sound-absorbent cover of claim 1 wherein said liner material further comprises a unitary piece of said sound-absorbent flexible porous substance.

7. The flexible sound-absorbent cover of claim 6 wherein said unitary piece includes portions defining an air passage leading to the air intake.

8. The flexible sound-absorbent cover of claim 1 wherein said liner material is a thermally insulative substance.

9. The flexible sound-absorbent cover of claim 1 wherein said outer skin is waterproof.

10. The flexible sound-absorbent cover of claim 1 wherein said outer skin further comprises portions defining a slit openable to facilitate installation of the cover and closable to hold the cover in place on the blower.

11. The flexible sound-absorbent cover of claim 10 wherein said slit further includes a fly.

12. The flexible sound-absorbent cover of claim 10 further comprising a fastener connected to said outer skin for keeping said slit closed.

* * * * *